US011142989B2

(12) United States Patent
Gan et al.

(10) Patent No.: US 11,142,989 B2
(45) Date of Patent: Oct. 12, 2021

(54) TOOL FOR JET PACKING AND FRACTURING AND TUBULAR COLUMN COMPRISING SAME

(71) Applicants: China Petroleum & Chemical Corporation, Beijing (CN); Sinopec Southwest Oil & Gas Company, Chengdu (CN)

(72) Inventors: Zhenwei Gan, Chengdu (CN); Bin Qi, Chengdu (CN); Shunqu Hu, Chengdu (CN); Zhimin Hou, Chengdu (CN); Yongmao Lin, Chengdu (CN); Yijun Zhou, Chengdu (CN); Lei Wang, Chengdu (CN); Tao Liu, Chengdu (CN); Wenjiang Teng, Chengdu (CN); Jingyu Cui, Chengdu (CN)

(73) Assignees: CHINA PETROLEUM & CHEMICAL CORPORATION, Beijing (CN); SINOPEC SOUTHWEST OIL & GAS COMPANY, Chengdu (CN)

( * ) Notice: Subject to any disclaimer, the term of this patent is extended or adjusted under 35 U.S.C. 154(b) by 683 days.

(21) Appl. No.: 16/071,125

(22) PCT Filed: Jan. 13, 2017

(86) PCT No.: PCT/CN2017/071169

§ 371 (c)(1),
(2) Date: Jul. 19, 2018

(87) PCT Pub. No.: WO2017/124980

PCT Pub. Date: Jul. 27, 2017

(65) Prior Publication Data

US 2021/0164318 A1 Jun. 3, 2021

(30) Foreign Application Priority Data

Jan. 20, 2016 (CN) ..... CN201610036947
Jan. 20, 2016 (CN) ..... CN201610038722

(51) Int. Cl.
*E21B 33/128* (2006.01)
*E21B 34/14* (2006.01)
*E21B 43/26* (2006.01)

(52) U.S. Cl.
CPC ..... *E21B 33/1285* (2013.01); *E21B 34/142* (2020.05); *E21B 43/26* (2013.01); *E21B 2200/06* (2020.05)

(58) Field of Classification Search
CPC ..... E21B 43/26; E21B 34/12; E21B 34/14; E21B 34/124; E21B 33/128; E21B 33/1285; E21B 2200/06
See application file for complete search history.

(56) References Cited

U.S. PATENT DOCUMENTS 8,720,561 B2 * 5/2014 Zhou ..... E21B 33/146 166/289
8,893,810 B2 * 11/2014 Zimmerman ..... E21B 43/26 166/386

(Continued)

FOREIGN PATENT DOCUMENTS

CN 103184856 A 7/2013
CN 103184867 A 7/2013

(Continued)

OTHER PUBLICATIONS

International Search Report for International Application No. PCT/CN2017/071169, dated May 2, 2017.

*Primary Examiner* — Kenneth L Thompson
(74) *Attorney, Agent, or Firm* — Finnegan Henderson Farabow Garrett & Dunner LLP

(57) ABSTRACT

A tool for perforating, packing and fracturing and a tubing string comprising the tool are disclosed. The tool comprises an upper connector, a connection sleeve, a mandrel, a packer, a lower connector, and an inner sleeve. The upper connector is provided with communication holes, and a nozzle is provided at each communication hole. The inner (Continued)

Figure 1:
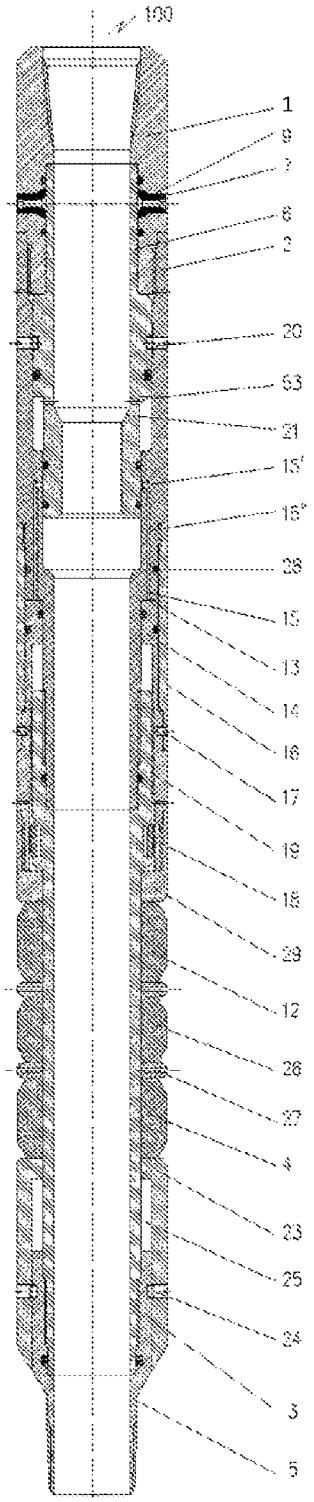

sleeve is provided on an inner wall of the upper connector to block the nozzle. Under an action of a fracturing fluid, the inner sleeve moves downwards to expose the nozzle, and the packer is packed. Then, perforating is performed through the nozzle. After perforating is finished, the nozzle is configured to be lost at a communication hole, and then fracturing is performed. When the tool is used, operation cost can be reduced, and reservoir stimulation effect can be improved.

12 Claims, 9 Drawing Sheets

(56) References Cited

U.S. PATENT DOCUMENTS

| | | | | |
|---|---|---|---|---|
| 9,297,241 | B2 * | 3/2016 | Arabskyy | E21B 34/063 |
| 10,704,362 | B2 * | 7/2020 | Themig | E21B 43/14 |
| 2011/0198096 | A1 * | 8/2011 | Mailand | E21B 43/26 166/373 |
| 2013/0248192 | A1 | 9/2013 | Cook | |
| 2014/0262290 | A1 * | 9/2014 | Bussear | E21B 33/124 166/308.1 |
| 2015/0034324 | A1 * | 2/2015 | Norrid | E21B 34/103 166/308.1 |

FOREIGN PATENT DOCUMENTS

| | | | |
|---|---|---|---|
| CN | 103266873 | A | 8/2013 |
| CN | 105201476 | A | 12/2015 |
| CN | 105672935 | A | 6/2016 |
| CN | 105672957 | A | 6/2016 |
| CN | 105672959 | A | 6/2016 |
| CN | 105696994 | A | 6/2016 |

* cited by examiner

TOOL FOR JET PACKING AND FRACTURING AND TUBULAR COLUMN COMPRISING SAME

CROSS-REFERENCE TO RELATED APPLICATIONS

This application is a national stage filing under 35 U.S.C. § 371 of International Application No. PCT/CN2017/071169, filed on Jan. 13, 2017, which claims priority to and benefits of Chinese Patent Application No. 201610038722.5, filed Jan. 20, 2016, and Chinese Patent Application No. 201610036947.7, filed Jan. 20, 2016, which are incorporated herein by reference in their entireties.

FIELD OF THE INVENTION

The present disclosure relates to the technical field of oil and gas well completion and reservoir stimulation, and particularly to a tool for perforating, packing and fracturing and a tubing string comprising the tool.

BACKGROUND OF THE INVENTION

With promotion of exploration and development of unconventional oil and gas reservoir, staged fracturing technology in well completion is developing rapidly as a main stimulation treatment during unconventional oil and gas resource production. The staged fracturing technology in well completion can perform reservoir stimulation purposefully so as to improve oil drainage area of oil and gas production layer and improve oil and gas productivity.

In the prior art, during multi-stage segmented reservoir stimulation, perforating is performed at first, and fracturing is performed later in general. That is, during reservoir stimulation, a perforating gun is run first to perform multi-stage segmented perforating so as to form a reservoir-hole in the reservoir. Then, the perforating gun is pulled out of the stratum. Next, a tubing string comprising a packer is descended, and a first ball is dropped therein to pack the packer. Once again, the first ball is dropped to open a first stage sliding sleeve of the packer so as to expose a first stage fracturing hole cooperating with the reservoir-hole. At last, fracturing fluid is pumped into the tubing string, and the fracturing fluid flows into the reservoir-hole through the fracturing hole to form crack in the stratum. After fracturing is finished, another first larger-sized ball is dropped therein to open upper stage sliding sleeve so as to fracture a next upstream layer stratum.

With the aforesaid method, reservoir stimulation can be performed, but the tubing string needs to be run many times to perform perforating and sand fracturing. As a result, with the aforesaid method, not only operation procedures and operation costs are increased, but also fracturing accuracy and precision are decreased.

SUMMARY OF THE INVENTION

With respect to part or total of the above technical problems in the prior art, the present disclosure provides a tool for perforating, packing and fracturing and a tubing string comprising the tool. Using the tool for perforating, packing and fracturing provided herein, the tubing string needs to be descended only once to operate perforating and fracturing. Therefore, when the tool for perforating, packing and fracturing is used, operation procedures and operation costs can be decreased, and fracturing accuracy and precision can be improved.

According to a first aspect, the present disclosure provides a tool for perforating, packing and fracturing. The tool comprises:

an upper connector, which is provided with communication holes for communicating inside and outside, a nozzle being provided at each communication hole;

a connection sleeve, which is provided at a lower end of the upper connector;

a mandrel, which is provided at a lower end of the connection sleeve;

a packer, which is provided on an outer wall of the connection sleeve and an outer wall of the mandrel, the packer comprising a rubber barrel assembly and a first pressure transmission hole which is provided in the connection sleeve;

a lower connector, which is provided at a lower end of the mandrel; and an inner sleeve, which is provided in an internal flowbore of the upper connector and is slidingly connected to the upper connector, in an initial state, the inner sleeve blocking the nozzles and the first pressure transmission hole, wherein after an internal flowbore of the inner sleeve is blocked, the inner sleeve is configured to be movable relative to the upper connector to expose the nozzle under an action of a first pressure. At the same time, the first pressure transmission hole is in communication with the internal flowbore of the inner sleeve so that the rubber barrel assembly deforms under an action of pressure and the packer is packed. Before a fracturing fluid is pumped into the inner sleeve, the nozzle is configured to be lost at a communication hole.

According to an embodiment, the packer further comprises:

an outer housing, with an upper end thereof being sleeve-connected in a fixed manner to the outer wall of the connection sleeve and a lower end thereof extending over the mandrel;

a piston cylinder, which is formed by an upper end surface of the mandrel, an inner wall of the outer housing, and the connection sleeve; and a piston, with an upper end thereof being provided in the piston cylinder and a lower end thereof extending downwards between the mandrel and the outer housing and abutting against the rubber barrel assembly, the piston being connected to the outer housing in a sliding manner, wherein the first pressure transmission hole is provided in the connection sleeve and is in communication with the piston cylinder. After the inner sleeve moves relative to the upper connector and enables the fracturing fluid to enter into the first pressure transmission hole, the fracturing fluid enters into the piston cylinder and pushes the piston to move downwards.

According to an embodiment, the inner sleeve is provided with a second pressure transmission hole in a wall thereof, and the second pressure transmission hole is configured to be in communication with the first pressure transmission hole after the inner sleeve moves downwards.

According to an embodiment, the first pressure transmission hole comprises a first part used for communicating with the second pressure transmission hole and a second part communicating with the first part and the piston cylinder. The first part is configured as a hole extending along a radial direction, and the second part is configured as a hole extending along an axial direction.

According to an embodiment, a reaming is provided at an inlet of the first part.

According to an embodiment, the tool further comprises an opener used for blocking the internal flowbore of the inner sleeve, the opener comprising:

an opener main body;

resilient pieces extending upwards from the opener main body;

a ball seat provided at a lower end of the opener main body; and a ball cooperating with the ball seat, wherein the resilient piece is provided with a protrusion to cooperate with grooves provided on an inner wall of the inner sleeve.

According to an embodiment, a retaining ring is provided at a lower end of the groove of the inner sleeve and is configured to be slidable in an axial direction relative to the inner sleeve, and a sealing element is provided between an upper end surface of the retaining ring and the inner sleeve so that the retaining ring compresses the sealing element during a process when the retaining ring moves upwards relative to the inner sleeve.

According to an embodiment, an elastic booster ring is provided between the opener main body and the ball seat.

According to an embodiment, a first ball seat is provided on an inner wall of the inner sleeve. When a first ball is dropped into the inner sleeve, the first ball seat is configured to cooperate with the first ball so as to close the inner sleeve. The first ball seat is at a lower end of the second pressure transmission hole.

According to an embodiment, a first ratchet is provided on the outer wall of the mandrel, and a second ratchet is provided on an inner wall of the piston to cooperate with the first ratchet.

According to an embodiment, a cross-sectional area of a communication hole decreases in a direction from inside to outside, and a shape of the nozzle matches the communication hole.

According to a second aspect, the present disclosure provides a tubing string which comprises the aforesaid tool.

According to an embodiment, the tubing string comprises a plurality of tools that are connected with each other in sequence, and a diameter of the first ball seat in the inner sleeve of the tool decreases in sequence in a direction from up to bottom.

Compared with the prior art, the present disclosure has the following advantages. The tubing string comprising the tools with this structure is descended into a reservoir, and the internal flowbore of the inner sleeve is closed. A fracturing fluid is pumped into the tubing string, and the inner sleeve moves relative to the connection sleeve under an action of the fracturing fluid to expose the nozzle. At the same time, the packer is packed. Hence, sand-carrying liquid can form a high-speed jet through the nozzle to enter the stratum, and reservoir perforation is finished. After reservoir perforation is finished, the nozzle is lost at a communication hole to increase a communication area between the connection sleeve and an annulus. Then, the fracturing fluid is pumped into the tubing string to perform large displacement fracturing. Thus, using the tool for perforating, packing and fracturing provided herein, the tubing string needs to be descended only once to realize perforating and fracturing. Therefore, when the tool for perforating, packing and fracturing is used, operation procedures and operation costs can be decreased. At the same time, during reservoir stimulation process, since after perforation is finished, fracturing is performed at a corresponding position, fracturing accuracy and precision can be ensured, and fracturing effect can be improved.

BRIEF DESCRIPTION OF THF DRAWINGS

Figure 1A:
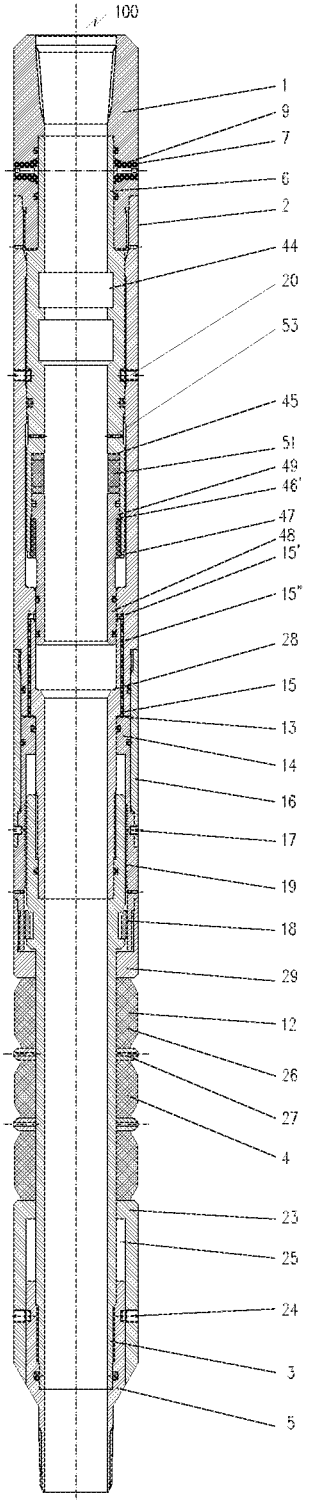
Figure 2:
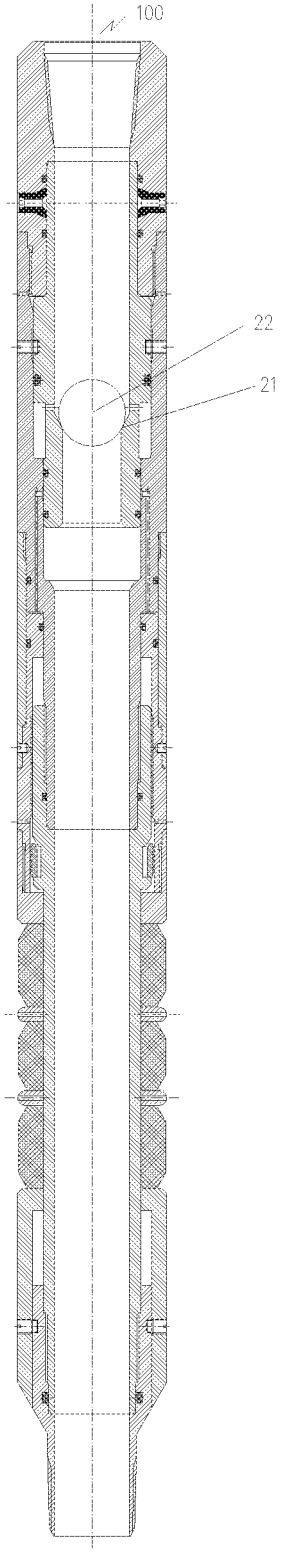
Figure 2A:
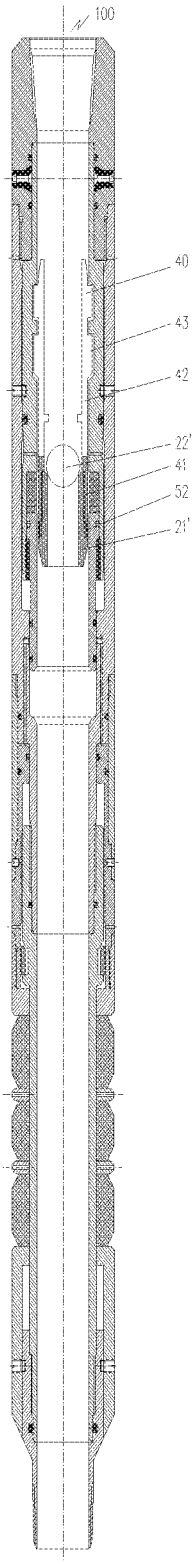
Figure 3:
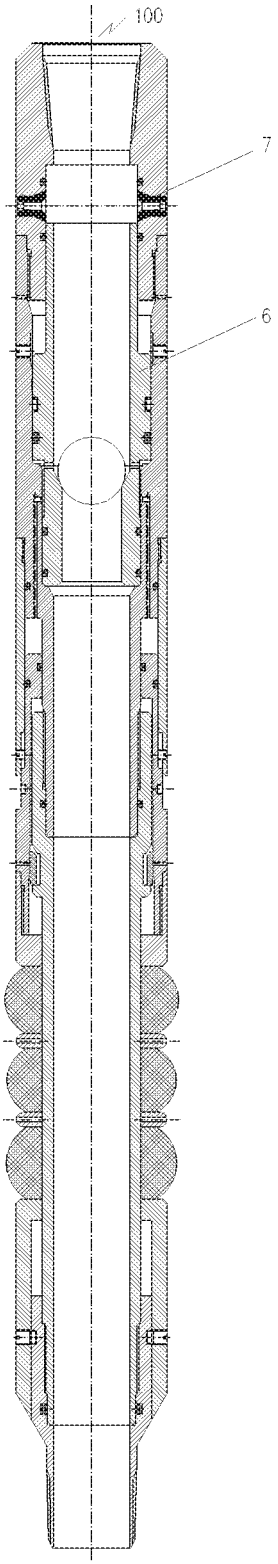
Figure 3A:
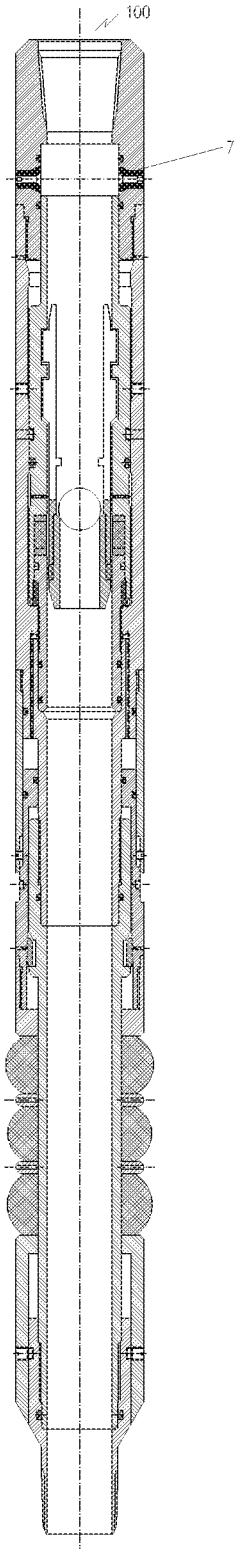
Figure 4:
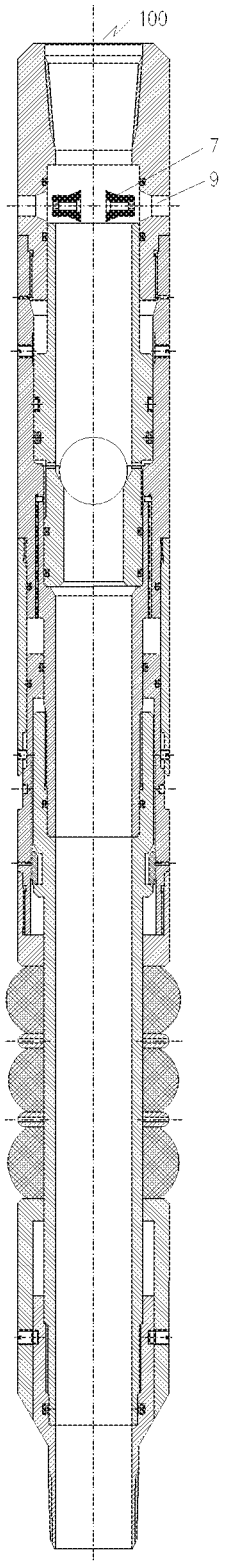
Figure 4A:
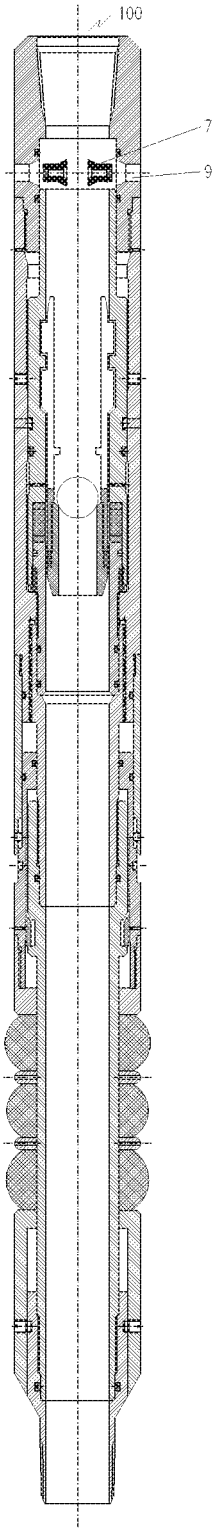
Figure 5:
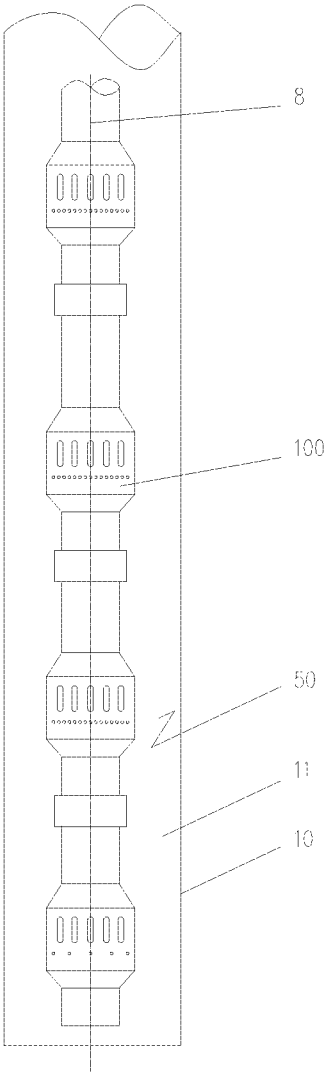

The preferred embodiments of the present disclosure will be further illustrated hereinafter with reference to the drawings. In the drawings:

FIG. 1 schematically shows a tool for perforating, packing and fracturing in an initial state according to a first embodiment of the present disclosure;

FIG. 2 schematically shows the tool for perforating, packing and fracturing in a state after a first ball is dropped therein according to the first embodiment of the present disclosure;

FIG. 3 schematically shows the tool for perforating, packing and fracturing in a state after an inner sleeve moves downwards according to the first embodiment of the present disclosure;

FIG. 4 schematically shows the tool for perforating, packing and fracturing in a state after a nozzle is lost according to the first embodiment of the present disclosure;

FIG. 5 schematically shows a tubing string according to the present disclosure;

FIG. 1A schematically shows a tool for perforating, packing and fracturing in an initial state according to a second embodiment of the present disclosure;

FIG. 2A schematically shows the tool for perforating, packing and fracturing in a state after an opener is dropped therein according to the second embodiment of the present disclosure;

FIG. 3A schematically shows the tool for perforating, packing and fracturing in a state after an inner sleeve moves downwards according to the second embodiment of the present disclosure; and FIG. 4A schematically shows the tool for perforating, packing and fracturing in a state after a nozzle is lost according to the second embodiment of the present disclosure.

In the drawings, the same components are represented by the same reference signs, and the size of each component does not represent the actual size of the corresponding component.

DETAILED DESCRIPTION OF THE EMBODIMENTS

The present disclosure will be further illustrated hereinafter with reference to the drawings.

FIG. 1 schematically shows a tool 100 for perforating, packing and fracturing in an initial state according to a first embodiment of the present disclosure. As shown in FIG. 1, the tool 100 comprises an upper connector 1, a connection sleeve 2, a mandrel 3, a packer 4 (component in a circle of FIG. 1), a lower connector 5, and an inner sleeve 6. The upper connector 1 is configured to have a cylindrical shape and is used for connecting a tubing 8 (as shown in FIG. 5) so as to carry the tool 100 to the reservoir. The upper connector 1 is provided with communication holes 9 for communicating inside and outside and used for fracturing operation. The connection sleeve 2 is provided at a lower end of the upper connector 1 and is configured to have a cylindrical shape. The mandrel 3 is provided at a lower end of the connection sleeve 2 and is configured to have a cylindrical shape. The packer 4 is provided on an outer wall of the lower end of the connection sleeve 2 and extends to an outer wall of the mandrel 3 so as to pack an annulus 11 between the tool 100 and a casing pipe 10, as shown in FIG. 5. The packer 4 comprises 5 a rubber barrel assembly 12 that is provided on the mandrel 3 and a first pressure transmission hole 15. The lower connector 5 is provided at a lower end of the mandrel 3 and is configured to have a cylindrical shape. The inner sleeve 6 is provided on an inner wall of the upper connector 1. In an initial state, the inner sleeve 6 is connected to the upper connector 1 in a fixed manner so as to pack the communication holes 9 and the first pressure transmission hole 15. A nozzle 7 is defined at a communication hole 9 by the inner sleeve 6. After perforation is finished, the nozzle 7 is configured to be lost at the communication hole 9 so as to expose the communication hole 9 and to perform fracturing operation. It needs to be explained that, the initial state here means a state in which a fracturing fluid is not pumped into the tool 100.

A tubing string 50 comprising the tool 100 with this structure is descended into the reservoir, and an internal flowbore of the inner sleeve 6 is closed. A fracturing fluid is pumped into the tubing string 50, and the inner sleeve 6 moves relative to the upper connector 1 under an action of the fracturing fluid to expose the nozzle 7, as shown in FIG. 3. At the same time, the fracturing fluid enters the first pressure transmission hole 15 through the internal flowbore of the inner sleeve 6 so that the packer 4 is packed. Hence, a sand-carrying liquid that is pumped into the inner sleeve 6 can form a high-speed jet through the nozzle 7 to enter the stratum, and reservoir perforation is finished. After reservoir perforation is finished, as shown in FIG. 4, the nozzle 7 is lost at a communication hole 9. Then, the fracturing fluid is pumped into the tubing string 50 and the annulus 11 to perform large displacement fracturing. Thus, using the tool 100 for perforating, packing and fracturing provided herein, the tubing string 50 needs to be descended only once to realize perforating and fracturing. Therefore, when the tool 100 for perforating, packing and fracturing is used, operation procedures and operation costs can be decreased. At the same time, during reservoir stimulation process, since after perforation is finished, fracturing is performed at a corresponding position, fracturing accuracy and precision can be ensured, and fracturing effect can be improved.

According to an preferred embodiment, a cross-sectional area of a communication hole 9 decreases in a direction from inside to outside, and a shape of the nozzle 7 matches the communication hole 9. For example, a cross-section of the communication hole 9 can be a trapezoid as shown in FIG. 1. When the nozzle 7 bears a pressure from inside to outside, the nozzle 7 is compressed at a position of the communication hole 9. When the nozzle 7 bears a pressure from outside to inside, the nozzle 7 drops from the communication hole 9. It should be noted that, in the initial state, the nozzle 7 is defined by the inner sleeve 6 and thus cannot drop. After perforation is finished, the fracturing fluid can be pumped into the annulus 11 so that the nozzle 7 is pushed to drop from the communication hole 9, as shown in FIG. 4.

According to another preferred embodiment, the nozzle 7 is made of a dissolvable material. In this case, after perforation is finished, a liquid which can dissolve the nozzle 7 can be pumped into the tubing 8 or the annulus 11 to expose the communication hole 9. For example, the nozzle 7 is made of an aluminum-magnesium alloy material. After perforation is finished, an acid can be pumped into the tubing 8 or the annulus 11 to dissolve the nozzle 7.

It should be noted that, in order to ensure smooth perforating and fracturing, the nozzle 7 can be provided at one part of the communication holes 9. Of course, the nozzle 7 can be made of a material which is undissolvable in the fracturing fluid for perforation only, and a plug made of a dissolvable material (such as a aluminum-magnesium alloy) can be provided at each of the other part of the communication holes 9. During perforating process, a sand-carrying liquid can enters into the stratum through the nozzle 7. After perforation is finished, a liquid which can dissolve the plug can be pumped into the tubing 8 or the annulus 11 to expose this part of communication holes 9 and to finish fracturing. With this arrangement, not only smooth perforating is ensured, but also the following fracturing procedure is ensured.

According to the present disclosure, as shown in FIG. 1, an inner sleeve seat 28 is provided on an inner wall of the connection sleeve 2 to limit a position of the inner sleeve 6. The inner sleeve seat 28 can be configured to be a shoulder structure to carry the inner sleeve 6. In this manner, the inner sleeve 6 moves downwards under an action of force and is carried by the inner sleeve seat 28 at last. Hence, a position of the inner sleeve 6 is limited. This structure is simple and easy to realize.

According to the present disclosure, the packer 4 comprises an outer housing 16, a piston cylinder 13, and a piston 14. An upper end of the outer housing 16 is sleeve-connected in a fixed manner to the outer wall of the connection sleeve 2, and the outer housing 16 extends downwards over the mandrel 3. In this manner, an upper end surface of the mandrel 3, an inner wall of the outer housing 16, and the connection sleeve 2 form the piston cylinder 13. An upper end of the piston 14 is provided in the piston cylinder 13 and a lower end thereof extends downwards between the mandrel 3 and the outer housing 16 and abuts against the rubber barrel assembly 12. At the same time, in an initial state, the piston 14 is connected to the outer housing 16 through a second shear pin 17. The first pressure transmission hole 15 is provided at a side wall of the connection sleeve 2. Besides, the first pressure transmission hole 15 is in communication with the piston cylinder 13, so that the fracturing fluid is pumped into the piston cylinder 13 through the first pressure transmission hole 15. Moreover, the first pressure transmission hole 15 is located at an upper end of an upper surface of the piston 14, so that the piston 14 can receive the fracturing fluid from the first pressure transmission hole 15. Accordingly, the inner sleeve 6 is provided with a second pressure transmission hole 53 in a wall thereof. In the initial state, the first pressure transmission hole 15 is closed by the inner sleeve 6. During a process when the fracturing fluid is pumped, the inner sleeve 6 moves downwards so that the second pressure transmission hole 53 is in communication with the first pressure transmission hole 15. In this manner, the fracturing fluid coming from the internal flowbore of the inner sleeve 6 enters the piston cylinder 13 through the second pressure transmission hole 53 and the first pressure transmission hole 15 and pushes the piston 14. Under an action of pressure, the second shear pin 17 breaks, and the piston 14 moves downwards. The piston 14 pushes the rubber barrel assembly 12 when it moves downwards, and the annulus 11 is packed by the rubber barrel assembly 12.

It should be noted that, after the inner sleeve 6 moves downwards to a right position, the second pressure transmission hole 53 and the first pressure transmission hole 15 can be in communication with each other in a contacting manner. Of course, the second pressure transmission hole 53 and the first pressure transmission hole 15 can also be in communication with each other through a gap formed between the connection sleeve 2 and the inner sleeve 6. In the latter case, an axial size of the inner sleeve 6 can be relatively reduced, so that the strength of the inner sleeve 6 can be improved, and a production cost can be reduced.

Preferably, the first pressure transmission hole 15 can comprise a first part 15' and a second part 15" communicating with the first part 15'. The first part 15' extends along a radial direction to communicate with the second pressure transmission hole 53. The second part 15" extends along an axial direction to communicate with the first part 15' and the piston cylinder 13 so as to provide a positive pressure to the piston 14 and push the piston 14 to move more effectively. More preferably, an inlet (i.e., a position which communicating with the second pressure transmission hole 53) of the first part 15' is configured as a flaring so as to better receive the fracturing fluid supplied from the second pressure transmission hole 53. With this arrangement, the second pressure transmission hole 53 can receive the fracturing fluid more easily, and a precision requirement for the tool 100 can be reduced.

In order to ensure packing safety, the rubber barrel assembly 12 comprises a plurality of rubber barrels 26, and spacers 27 are arranged between two adjacent rubber barrels 26. In another alternative case, no spacer is arranged between two adjacent rubber barrels. For example, the rubber barrel assembly 12 comprises three rubber barrels. With this arrangement, packing effect of the packer 4 can be improved, and perforating and fracturing efficiencies of the tool 100 can be ensured.

In order to ensure that a rubber barrel 26 bears a uniform force, a rod 29 is provided between the piston 14 and the rubber barrel assembly 12 to transmit the force from the piston 14 to the rubber barrel assembly 12. An upper end of the rod 29 is connected to the piston 14 in a fixed manner; a lower end thereof is connected to the mandrel 3 in a sliding manner; and a lower end surface thereof abuts against the rubber barrel 26.

In order to prevent the rubber barrel assembly 12 from moving back, a first ratchet 18 is provided on the outer wall of the mandrel 3, and a second ratchet 19 is provided on an inner wall of the piston 14. During a process when the piston 14 moves downwards, the second ratchet 19 moves downwards accordingly. After the piston 14 moves to a right position so that the rubber barrel 26 expands to pack the annulus 11, the second ratchet 19 cooperates with the first ratchet 18 to prevent the rubber barrel assembly 12 from returning back. With this arrangement, packing safety of the packer 4 can be ensured, and the following perforating and fracturing operations can be ensured.

According to the present disclosure, in the initial state, in order to maintain the inner sleeve 6 at a right position, the inner sleeve 6 is connected to the connection sleeve 2 through a first shear pin 20. Hence, during a process when the internal flowbore of the inner sleeve 6 is blocked and the fracturing fluid is pumped therein, the first shear pin 20 breaks with the increasing pressure, so that the inner sleeve 6 moves downwards to expose the nozzle 7. This structure is simple and easy to realize.

According to one embodiment of the present disclosure, in order to block the inner sleeve 6, as shown in FIG. 2, a first ball seat 21 is provided on an inner wall of the inner sleeve 6. After the tool 100 is descended into the stratum, a first ball 22 is dropped into the inner sleeve 6 from ground. The first ball 22 and the first ball seat 21 cooperate with each other to close the inner sleeve 6. At this time, the fracturing fluid can be pumped to the tool 100. Besides, in order to ensure that the internal flowbore of the inner sleeve 6 can provide the fracturing fluid to the packer 4 so that the packer 4 is packed after the first ball 22 is dropped therein, the second pressure transmission hole 53 is provided at an upper end of the first ball seat 21.

As shown in FIG. 1, the tool 100 further comprises an unpacking retaining ring 23 disposed at a lower end of the packer 4. An upper end of the unpacking retaining ring 23 is sleeve-connected to the outer wall of the mandrel 3 and is connected to the mandrel 3 in a sliding manner. An upper end surface of the unpacking retaining ring 23 abuts against the rubber barrel 26, and a lower end thereof is connected to the lower connector 5 in a fixed manner through a third shear pin 24. At the same time, the unpacking retaining ring 23, the mandrel 3 and the lower connector 5 forms a first space 25 which serves as a buffer space. In a condition when the packer 4 needs to be unpacked, the upper connector 1 can be pulled up, and the mandrel 3 and the lower connector 5 have a trend to move upwards with the upper connector 1. Since the rubber barrel 26 and the annulus 11 are in frictional contact with each other, the third shear pin 24 breaks under an action of a pulling force. After the third shear pin 24 breaks, the unpacking retaining ring 23 and the lower connector 5 move relative to each other so that the rubber barrel 26 returns back and the packer 4 is unpacked. With this arrangement, work safety of the tool 100 can be improved, and the tubing string 50 can be pulled out of the casing pipe 10 in emergency situations.

The present disclosure further relates to a tubing string 50. The tubing string 50 comprises a tubing. 8 and a tool 100 that is connected with the tubing 8 in a fixed manner, as shown in FIG. 5. In order to improve reservoir stimulation scale and work efficiency, a plurality of tools 100 that are connected with each other in sequence can be provided corresponding to one tubing string 50. In order to realize blocking of the inner sleeve 6, a ball blocking method can be used. Moreover, diameter of the first ball seat 21 of different inner sleeves 6 of the tool 100 decreases in sequence in a direction from top to bottom. In this case, after the tubing string 50 is descended into the stratum, the first balls 22 with different diameters can be dropped therein to push the inner sleeves 6 to move staged, so as to realize staged perforating and fracturing. In particular, when perforating and fracturing are performed on the present stage of stratum, since packing of the packers 4 above a target layer is not started yet, and the packers 4 of the target layer and below the target layer are already packed, the sand-carrying liquid or the fracturing fluid can only enter into the stratum through the present stage of tool 100. Therefore, when the tool with this structure is used, a requirement for ground pumping equipment is low. That is, in a condition that the ground pumping equipment does not change, a higher operation displacement and a better fracturing effect can be realized.

The reservoir stimulation method using the tubing string 50 comprising the tool 100 will be illustrated in detail hereinafter with reference to FIGS. 1 to 5.

In a first step, the tubing string 50 which comprises the tubing 8 and the tool 100 is descended into the casing pipe 10 to form the annulus 11 between the tubing string 50 and the casing pipe 10.

In a second step, the first ball 22 is dropped into the tubing 8. The first ball 22 and the first ball seat 21 in a corresponding stage of inner sleeve 6 cooperate with each other to block an inner channel of the inner sleeve 6.

In a third step, the fracturing fluid is pumped into the tubing 8. The fracturing fluid is blocked by the first ball seat 21 in the corresponding stage. When the pressure is high enough to break the first shear pin 20, the first shear pin 20 breaks, and the inner sleeve 6 moves downwards to the inner sleeve seat 28 so as to expose the nozzle 7. At the same time, after the inner sleeve 6 moves downwards, the second pressure transmission hole 53 and the first pressure transmission hole 15 are in communication with each other, and the fracturing fluid enters into the piston cylinder 13 through the first pressure transmission hole 15 to push the piston 14 to move downwards. The rod 29 acts on the rubber barrel 26, and the rubber barrel 26 expands to realize packing of the packer 4.

In a fourth step, after the packer 4 is packed, the sand-carrying liquid is pumped into the tubing 8. The sand-carrying liquid shoots out at a high speed by a throttle role of the nozzle 7 and enters into the stratum after passing through the casing pipe 10 to fonn a reservoir-hole in the stratum.

In a fifth step, after perforating is finished, the fracturing fluid is pumped into the annulus 11. Since the packer 4 is packed, the fracturing fluid acts on the nozzle 7. Under an action of pressure, the nozzle 7 drops from the communication hole 9 to expose the communication hole 9. It should be noted that, in this step, if the nozzle 7 is made of a dissolvable material, a material which can dissolve the nozzle 7 can be pumped into the tubing 8 or the annulus 11 to dissolve the nozzle 7 so as to expose the communication hole 9.

In a sixth step, the fracturing fluid is pumped into the tubing 8. The fracturing fluid enters into the reservoir-hole which is formed in the stratum during the perforating step through the communication hole 9 to perform fracturing. During this process, in order to increase the displacement and improve a fracturing effect, when the fracturing fluid is pumped into the tubing 8, the fracturing fluid can also be pumped into the annulus 11 at the same time to supplement the liquid.

After perforating and fracturing of the present stage of stratum are finished, the second step to the sixth step are repeated to perform perforating and fracturing on the next stage of stratum. In this manner, multi-stage perforating and fracturing of the reservoir can be performed by one tubing string 50. Therefore, operation procedures can be reduced, and work efficiency can be improved.

According to the present disclosure, an opener 40 can also be used to realize close of the internal flowbore of the inner sleeve 6 instead of dropping the ball in the first embodiment. Other structures and work principles of the tool 100 in the second embodiment are basically the same as those of the tool 100 in the first embodiment. Thus, only the opener 40 and some structures cooperating with the opener 40 will be illustrated below.

In order to block the internal flowbore of the inner sleeve 6, the tool 100 comprises the opener 40. As shown in FIGS. 1A to 4A, the opener 40 comprises an opener main body 41, resilient pieces 42, a ball seat 21' and a ball 22'. The opener main body 41 is configured to have a cylindrical shape and is disposed in the inner sleeve 6. The resilient piece 42 is arranged at an upper end of the opener main body 41.

Preferably, a plurality of resilient pieces 42 can be arranged and distributed in peripheral direction. The ball seat 21' is provided at a lower end of the opener main body 41 to accommodate the ball 22'. The resilient piece 42 is provided with a protrusion 43. Accordingly, the inner sleeve 6 is provided with a groove 44 to cooperate with the protrusion 43. During a process when the opener 40 is dropped into the inner sleeve 6, when the opener 40 meets the inner sleeve 6 matching it, the resilient piece 42 bounces outwards, so that the protrusion 43 and the groove 44 cooperate with each other and the opener 40 is positioned in the inner sleeve 6, in this case, an internal circulation path of the inner sleeve 6 is blocked, and the fracturing fluid can be pumped therein to push the inner sleeve 6 to move downwards. With cooperation of the opener 40 having this structure and the inner sleeve 6, the downward moving of the inner sleeve 6 can be realized. The problems such as full-bore cannot be realized and stage limitation when the inner sleeve 6 is pushed to move downwards by dropping a ball therein can be avoided. That is, with this arrangement, full-bore of the piple column 50 can be realized, and "countless" stage fracturing construction can be realized as well.

According to the present disclosure, in a direction from top to bottom, a first stage 45 is arranged on an inner wall of a lower end of the groove 44 of the inner sleeve 6. At the same time, a limiting part 47 is arranged on an inner wall of a lower end of the inner sleeve 6. The limiting part 47 is configured to have a cylindrical shape and is connected to the inner sleeve 6 in a fixed manner. A second stage 46' protruding inwards in a radial direction is formed. Accordingly, a retaining ring 48 is arranged at the lower end of the groove 44, and the retaining ring 48 is configured to have a cylindrical shape. In addition, a protruding ring 49 protruding outwards in the radial direction is arranged at an axial middle part of an outer wall of the retaining ring 48. A lower end surface of the protruding ring 49 abuts against the second stage 46', so that an upper end surface of the retaining ring 48 faces the first stage 45, and a lower end surface of the retaining ring 48 extends over a lower end surface of the inner sleeve 6. Meanwhile, a sealing element 51 is provided between the upper end surface of the retaining ring 48 and the first stage 45. Preferably, the sealing element 51 can be made of rubber. The opener 40 is dropped so that the opener 40 and the inner sleeve 6 move downwards together. After the retaining ring 48 recombines with the inner sleeve seat 28, the inner sleeve 6 and the limiting part 47 move downwards continuously so that the sealing element 51 expands to improve sealing performance between the inner sleeve 6 and the opener 40. With this arrangement, the sealing performance between the inner sleeve 6 and the opener 40 can be improved, and it can be ensured that the inner sleeve 6 can move downwards smoothly after the fracturing fluid is pumped.

According to the present disclosure, an elastic booster ring 52 is provided in an axial direction between the opener main body 41 and the ball seat 21'. Preferably, the elastic booster ring 52 can be a rubber ring. Since the elastic booster ring 52 is arranged, a gap between the opener 40 and the tubing 8 and the like can be reduced. Hence, when the opener 40 is sent by adding pressure, liquid leakage can be reduced, and the opener 40 can be sent more smoothly.

In the present application, the directional terms such as "upper" and "lower" are used taking a case in which the tool 100 is descended into the stratum as a reference.

The preferred embodiments of the present disclosure are illustrated hereinabove, but the protection scope of the present disclosure is not limited by this. Any person skilled in the art can make amendments without departing from the spirit and scope of the present disclosure. The protection scope of the present disclosure shall be determined by the scope as defined in the claims.

The invention claimed is:

1. A tool for perforating, packing and fracturing, comprising:

an upper connector, which is provided with communication holes for communicating inside and outside, a nozzle being provided at each communication hole;

a connection sleeve, which is provided at a lower end of the upper connector;

a mandrel, which is provided at a lower end of the connection sleeve;

a packer, which is provided on an outer wall of the connection sleeve and an outer wall of the mandrel, the packer comprising a rubber barrel assembly and a first pressure transmission hole which is provided in the connection sleeve;

a lower connector, which is provided at a lower end of the mandrel; and an inner sleeve, which is provided in an internal flowbore of the upper connector and is slidingly connected to the upper connector, in an initial state, the inner sleeve blocking the nozzles and the first pressure transmission hole, wherein after an internal flowbore of the inner sleeve is blocked, the inner sleeve is configured to be movable relative to the upper connector to expose the nozzle under an action of a first pressure, at the same time, the first pressure transmission hole is in communication with the internal flowbore of the inner sleeve so that the rubber barrel assembly deforms under an action of pressure and the packer is packed, before a fracturing fluid is pumped into the inner sleeve, the nozzle is configured to be detached from at least one of the communication holes.

2. The tool according to claim 1, wherein a cross-sectional area of at least one of the communication holes decreases in a direction from inside to outside, and a shape of the nozzle matches at least one of the communication holes.

3. The tool according to claim 1, wherein the packer further comprises:

an outer housing, with an upper end thereof being sleeve-connected in a fixed manner to the outer wall of the connection sleeve and a lower end thereof extending over the mandrel;

a piston cylinder, which is formed by an upper end surface of the mandrel, an inner wall of the outer housing, and the connection sleeve; and a piston, with an upper end thereof being provided in the piston cylinder and a lower end thereof extending downwards between the mandrel and the outer housing and abutting against the rubber barrel assembly, the piston being connected to the outer housing in a sliding manner, wherein the first pressure transmission hole is provided in the connection sleeve and is in communication with the piston cylinder, after the inner sleeve moves relative to the upper connector and enables the fracturing fluid to enter into the first pressure transmission hole, the fracturing fluid enters into the piston cylinder and pushes the piston to move downwards.

4. The tool according to claim 3, wherein a first ratchet is provided on the outer wall of the mandrel, and a second ratchet is provided on an inner wall of the piston to cooperate with the first ratchet.

5. The tool according to claim 3, wherein the inner sleeve is provided with a second pressure transmission hole in a wall thereof, and the second pressure transmission hole is configured to be in communication with the first pressure transmission hole after the inner sleeve moves downwards.

6. The tool according to claim 5, wherein a first ball seat is provided on an inner wall of the inner sleeve, when a first ball is dropped into the inner sleeve, the first ball seat is configured to cooperate with the first ball so as to close the inner sleeve, and the first ball seat is at a lower end of the second pressure transmission hole.

7. The tool according to claim 5, wherein the first pressure transmission hole comprises a first part used for communicating with the second pressure transmission hole and a second part communicating with the first part and the piston cylinder; and wherein the first part is configured as a hole extending along a radial direction, and the second part is configured as a hole extending along an axial direction.

8. The tool according to claim 7, wherein a reaming is provided at an inlet of the first part.

9. The tool according to claim 5, further comprising an opener used for blocking the internal flowbore of the inner sleeve, the opener comprising:

an opener main body;

resilient pieces extending upwards from the opener main body;

a ball seat provided at a lower end of the opener main body; and a ball cooperating with the ball seat, wherein the resilient pieces are provided with a protrusion to cooperate with grooves provided on an inner wall of the inner sleeve.

10. The tool according to claim 9, wherein a retaining ring is provided below the grooves of the inner sleeve and is configured to be slidable in an axial direction relative to the inner sleeve, and a sealing element is provided between an upper end surface of the retaining ring and the inner sleeve so that the retaining ring compresses the sealing element during a process when the retaining ring moves upwards relative to the inner sleeve.

11. The tool according to claim 9, wherein an elastic booster ring is provided between the opener main body and the ball seat.

12. A tubing string, comprising the tool according to claim 1.

* * * * *